US008088724B2

(12) United States Patent
Iverson et al.

(10) Patent No.: US 8,088,724 B2
(45) **Date of Patent: *Jan. 3, 2012**

(54) HARD SURFACE CLEANER WITH EXTENDED RESIDUAL CLEANING BENEFIT

(75) Inventors: Robert D. Iverson, Racine, WI (US); Francis J. Randall, Racine, WI (US); Richard W. Avery, High Wycombe (GB); John R. Wietfeldt, Franksville, WI (US); Ashish Taneja, Racine, WI (US); Tantiboro S. Ouattara, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/801,032

(22) Filed: May 18, 2010

(65) Prior Publication Data

US 2010/0234268 A1 Sep. 16, 2010

Related U.S. Application Data

(63) Continuation of application No. 11/889,542, filed on Aug. 14, 2007, now Pat. No. 7,741,265.

(51) Int. Cl.

| | |
|---|---|
| *C11D 3/37* | (2006.01) |
| *C11D 1/68* | (2006.01) |
| *C11D 3/43* | (2006.01) |
| *C11D 7/08* | (2006.01) |

(52) U.S. Cl. ..... 510/475; 510/191; 510/238; 510/240; 510/259; 510/421; 510/470; 510/474; 510/504; 510/506

(58) Field of Classification Search ..... 510/191, 510/238, 240, 259, 421, 470, 474, 475, 504, 510/506

See application file for complete search history.

(56) References Cited

U.S. PATENT DOCUMENTS

| | | | | |
|---|---|---|---|---|
| 6,251,849 | B1 * | 6/2001 | Jeschke et al. | 510/470 |
| 7,741,265 | B2 * | 6/2010 | Iverson et al. | 510/475 |
| 2003/0083223 | A1 * | 5/2003 | Aubay et al. | 510/475 |

* cited by examiner

*Primary Examiner* — Brian P Mruk

(57) ABSTRACT

A cleaning composition for a hard surface is disclosed which provides for initial cleaning of the hard surface and provision of a hydrophilic coating or barrier layer on the surface which provides residual cleaning to the hard surface for an extended number of rinsings. The composition includes a hydrophilic polymer, at least one nonionic surfactant, at least one solvent, an acid and water, wherein the acid provides the composition with a pH of about 2 to 3.5 and the composition is provided in the absence of any anionic, cationic or amphoteric surfactant.

23 Claims, 4 Drawing Sheets

HARD SURFACE CLEANER WITH EXTENDED RESIDUAL CLEANING BENEFIT

CROSS REFERENCE TO RELATED APPLICATION

This application is a continuation of U.S. Ser. No. 11/889,542 filed Aug. 14, 2007, now U.S. Pat. No. 7,741,265 B2.

FIELD OF INVENTION

The present invention is directed to a cleaning composition for treating hard surfaces. The composition provides upon application to a hard surface initial cleaning of the surface through removal of soils, such as dirt, soap scum and limescale, and provides for residual or after-cleaning of soils from the treated surface by simple rinsing with water. The residual cleaning benefit is achieved by provision of a coating or barrier layer on the surface treated in the nature of a hydrophilic film, the film providing good sheeting action and being capable of removing soils from the surface multiple times over an extended period through simple rinsing with water.

BACKGROUND OF INVENTION

Hard surface cleaners, especially in the form of trigger sprays and aerosol sprays, are useful on a variety of surfaces, including most notably household surfaces such as bathroom and kitchen surfaces. Bathroom and kitchen surfaces include a variety of smooth surfaces which when clean have a glossy or shiny surface, e.g. glass, ceramic, chrome, stainless steel and the like. During use between cleanings, build-up occurs on these surfaces from soils, such as dirt, soap scum, limescale and the like. This build-up can occur quickly and result in a dull look and roughened surface texture or feel. A consumer therefore experiences frustration over how quickly a surface, such as a household sink or tiling can get dirty after investing time and effort in cleaning. A consumer desires to have and experience the cleaning benefit over an extended period of time with no or minimal additional action being necessary.

The composition of the invention meets such consumer need by initially cleaning a hard surface and, thereafter, leaving a protective and hydrophilic coating on the hard surface that allows for easier removal of soils from the treated surface through simple rinsing with water. This hydrophilic coating remains on a treated surface for an extended period of time through numerous rinsings.

SUMMARY OF INVENTION

The present invention involves a composition which provides both initial and residual cleaning of hard surfaces. The composition is in particular useful on high energy surfaces, including glass, ceramic, marble, metal (such as chrome and stainless steel) and the like.

The cleaning composition includes a hydrophilic polymer in combination with at least one nonionic surfactant. More particularly, the cleaning composition includes a hydrophilic polymer, at least one nonionic alkoxylated alcohol surfactant, at least one solvent, an acid to provide the composition with an acidic pH in a range of about 2 to about 3.5, and water, wherein the composition does not include any anionic, cationic or amphoteric surfactant therein. The polymers and the acid are non-interactive with each other.

The hydrophilic polymer and nonionic alkoxylated alcohol surfactant serve to form a hydrophilic film layer on a hard surface treated with the cleaning composition. This film layer, which is not visible to the unaided eye, provides for extended residual cleaning benefits. Upon simple rinsing with a liquid, preferably a neutral liquid such as water, the treated surface provides for removal of soils therefrom. The amounts of nonionic surfactant and polymer, as well as the pH of the composition, control the sorption of composition components in the formation of the film layer and the partial dissolutions of the film layer through a plurality of subsequent rinsings.

Hydrophilic polymers suitable for use in combination with the nonionic alkoxylated alcohol surfactant include at least (1) an acidic monomer having or capable of forming an anionic charge and (2) a monomer having a permanent cationic charge or is capable of forming a cationic charge upon protonation. The polymer is preferably a polyampholyte. Further, the polymer is preferably an aqueous based acrylic acid amine-functional polymer. An example of such a polymer is a quaternized ammonium acrylamide acrylic acid copolymer. Hydrophilic polymers suitable for inclusion in the composition of the invention are described in U.S. Pat. Nos. 6,569,261, 6,593,288, 6,703,358 and 6,767,410, the disclosures of which are incorporated herein by reference. These patent documents describe water-soluble or water-dispersible copolymers including, in the form of polymerized units, (1) at least one amine-functional monomer, (2) at least one hydrophilic monomer with an acidic nature and (3) optionally at least one hydrophilic monomer with ethylenic unsaturation and with a neutral charge. The copolymers include quaternized ammonium acrylamide acid copolymers. It will be appreciated that selection of appropriate relevant materials and structures as to the polymer should be guided in more detail by the teachings of these patent documents. A preferred copolymer of the above type is produced by Rhodia and sold under the tradename MIRAPOL SURF S, in particular that sold under the tradename MIRAPOL SURF S-210. When the polymer has a cationic character, irrespective of the pH of the composition, the polymer will have a net positive charge, unless the pH is over 7 in which case the polymer will be zwitterionic and depending on the acrylic acid content could have a net negative charge. The preferred compositions are acidic. MIRAPOL SURF S-210 carries a net positive charge at pH 2.65.

The at least one nonionic alkoxylated alcohol surfactant is preferably a $C_{10}$-$C_{15}$ ethoxylated alcohol having 6-8 ethylene oxide groups, in particular preferably an ethoxylated $C_{10}$ Guerbet alcohol having an HLB of from about 10 to about 15, preferably from about 12 to about 15. A most preferred nonionic surfactant is an ethoxylated $C_{10}$ Guerbet alcohol having an HLB of about 13, such as the surfactant produced by BASF Corp. and sold under the tradename LUTENSOL XL70.

The acidic aqueous composition include the above-described hydrophilic polymer and nonionic surfactant in amounts, respectively, of about 0.05 to about 1 wt. % based on solids or actives of the polymer in solution and about 1.5 to about 5 wt. %, upon application to a hard surface, provides for initial cleaning of a hard surface to remove dirt, soap scum, limescale and the like from the surface and leave behind, following drying, a barrier layer which provides residual cleaning over an extended period through subsequent use of the treated surface. The residual cleaning occurs by the barrier layer affecting the attachment of dirt and soap scum to the treated surface by, among other things, providing sheeting action and through repeated partial dissolutions of the barrier layer for continued removal of soils from the surface, better rinsing, uniform drying and shine of the surface.

Cleaning compositions according to the invention are more specifically described below.

BRIEF DESCRIPTION OF THE DRAWINGS

Referring to the drawings.

DETAILED DESCRIPTION OF PREFERRED EMBODIMENTS

Figure 1:
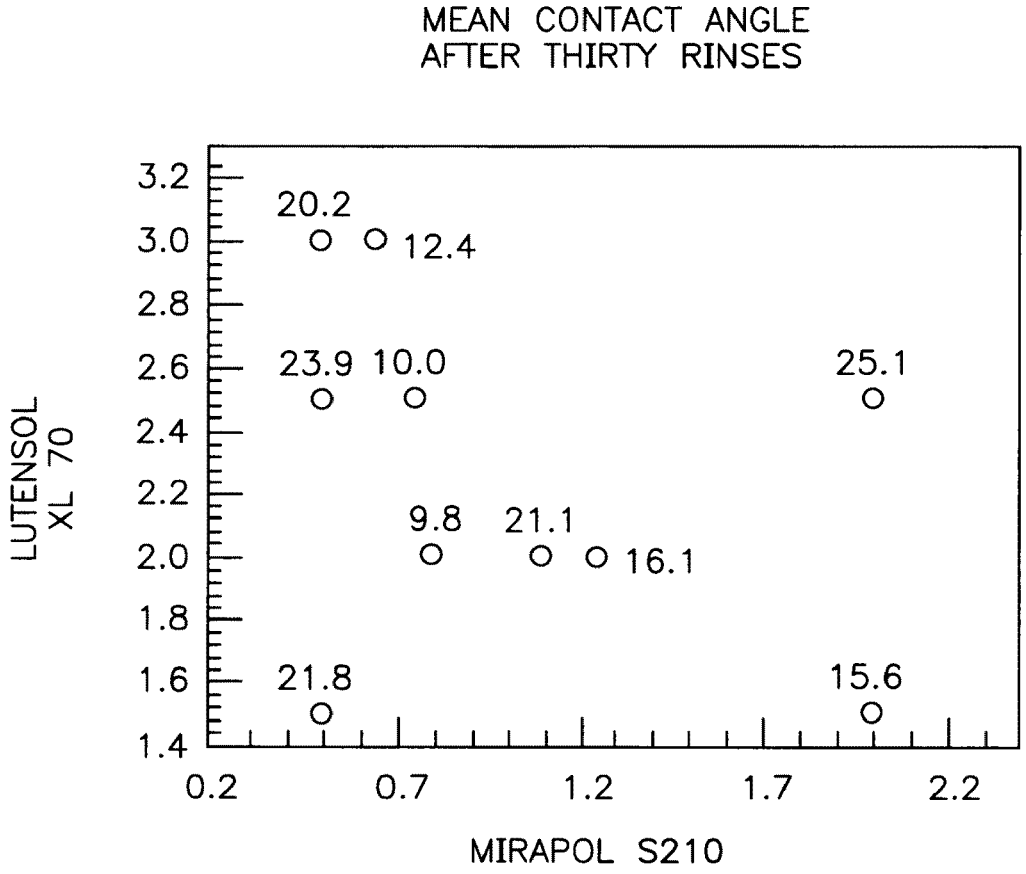
FIG. 1 shows mean contact angles after 30 rinses for variations as to amounts of polymer and nonionic surfactant of a preferred embodiment of the invention.

The invention is directed to a cleaning composition for treating hard surfaces to both initially clean the hard surface upon application of the composition to the hard surface and to provide residual cleaning for an extended period of time upon simple rinsing of the treated surface with a liquid. While the liquid need not be of a particular pH, the liquid preferably has a neutral pH to obtain optimum rinsing. A preferred liquid for rinsing is water. The residual cleaning is obtained through the formation of a barrier layer in the nature of a hydrophilic film upon the hard surface following treatment of the hard surface with a composition of the invention. The cleaning composition includes (a) a hydrophilic polymer including
  (1) a monomer having a permanent cationic charge or is capable of forming a cationic charge upon protonation;
  (2) an acidic monomer having or capable of forming an anionic charge; and
  (3) optionally, a monomer having a neutral charge;
(b) at least one nonionic surfactant which includes at least one alkoxylated long chain alcohol;
(c) at least one solvent;
(d) at least one acid present in an amount sufficient to provide the composition with an acidic pH in a range of from about 2 to about 3.5; and
(e) water, wherein the composition is provided in the absence of any anionic, cationic or amphoteric surfactant. The polymer and acid lack activity with respect to each other.

More particularly, the composition includes (a) about 0.05 to about 1 wt. % based on solids or actives of the hydrophilic polymer;
(b) about 1.5 to about 5 wt. % of the at least one nonionic surfactant;
(c) about 1 to about 4 wt. % of the at least one solvent;
(d) at least one acid in an amount sufficient to provide the composition with a pH in a range from about 2 to about 3.5; and
(e) a balance of water;

wherein the composition is provided in absence of any anionic, cationic or amphoteric surfactant.

The ratio of nonionic surfactant to polymer, based on wt. % present in the composition, is preferably in a range of from about 7:1 to about 25:1, more preferably of from about 17:1.

Polymer

Hydrophilic polymers suitable for use in the cleaning composition of the invention have a polyampholyte structure wherein the charge and surface adsorption are determined by pH. In particular, suitable hydrophilic polymers include at least (1) an acidic monomer having or capable of forming an anionic charge, (2) a monomer having a permanent cationic charge or is capable of forming a cationic charge upon protonation and, (3) optionally, a neutral monomer. Further, preferably, the polymer is an acrylic acid amine-functional polymer. More preferably, examples of suitable hydrophilic polymers are described in U.S. Pat. Nos. 6,569,261, 6,593,288, 6,703,358 and 6,767,410, the disclosures of which are incorporated herein by reference. These patent documents describe water-soluble or water-dispersible copolymers including, in the form of polymerized units, (1) at least one amine-functional monomer, (2) at least one hydrophilic monomer with an acidic nature and (3) optionally at least one hydrophilic monomer with ethylenic unsaturation and with a neutral charge. The copolymers include quaternized ammonium acrylamide acid copolymers. It will be appreciated that selection of appropriate relevant materials and structures as to the polymer should be guided in more detail by the teachings of these patent documents.

Particularly suitable polymers are nitrogen-containing polymers such as quaternized ammonium acrylamide acrylic acid copolymers, e.g., diallyl dimethyl ammonium chloride/acrylamide/acrylic acid copolymer. Preferred examples of the acidic monomer (a) include acrylic acid and methylacrylic acid. A preferred example of a cationic monomer (b) is methacrylamido(propyl)-trimethyl ammonium chloride. A preferred neutral monomer, when present, is dimethyl amidoethyl methacrylate. Commercially available hydrophilic polymers useful in the present composition are produced by Rhodia and sold under the tradename MIRAPOL SURF S. A most preferred MIRAPOL SURF S polymer is sold under the tradename MIRAPOL SURF S-210.

Without being limited thereto, it is believed that the hydrophilic polymer remains in cationic form at the acidic pH of the composition. This allows the polymer to attach itself to charged sites on a high energy hard surface, such as a glass or ceramic surface. The polymer provides hydrophilic characteristics to the barrier film formed on a hard surface following treatment with the composition, as well as operates in combination with the at least one nonionic alkoxylated alcohol surfactant (as further described below) to provide the film with residual cleaning benefit for an extended period of usage. The polymer combines with the alkoxylated alcohol nonionic surfactant to form an enhanced film on the surface treated. The ratio of polymer to surfactant is an important parameter in optimization of the residual hydrophilic film. As the polymer level increases, the optimal surfactant level decreases. The acidic pH of the composition promotes the removal of soils, such as limescale and soap scum from surfaces. The hydrophilic polymer is present in the cleaning composition in an amount of from about 0.05 to about 1 wt. % based on solids or actives, preferably about 0.1 to about 0.5 wt. %, more preferably about 0.13 to about 0.4 wt. %, and most preferably about 0.15 wt. %, each based on solids or actives.

Nonionic Surfactant

The at least one nonionic surfactant present in the cleaning composition includes at least one alkoxylated long chain ($C_{10-15}$) alcohol, preferably an ethoxylated long chain alcohol. The nonionic surfactant serves, among other things, the function of providing stability to the composition by controlling the phase separation of the composition and operates in conjunction with the polymer to provide the residual cleaning benefit, in particular optimal sheeting action.

The composition of the invention is a single phase composition on the border between single phase and multiple phase compositions based on controlling the relative amounts of the polymer and alkoxylated long chain alcohol nonionic surfactant. FIG. 1 shows an example of a composition according to the invention including components as set forth in Formula 1 below in the Examples, including various amounts of nonionic surfactant (LUTENSOL XL70, an ethoxylated $C_{10}$ Guerbet alcohol with 7 ethylene oxide (EO) groups) and polymer (MIRAPOL SURF S-210) and indicating the mean contact angle therefore after 30 rinses. (The contact angle was tested using the procedure of Test B as described below.) A preferred formulation as set forth in Formula 1 below including 0.75 wt. % (0.15 wt. % actives) MIRAPOL SURF S-210 as the polymer and 2.5 wt. % of LUTENSOL XL70 as the nonionic surfactant has a mean contact angle of 10.0. Stability is an important feature provided by the interacting nonionic surfactant and hydrophilic polymer. The amounts of the alkoxylated long chain alcohol nonionic surfactant and the polymer in the composition are chosen to be near a two phase region for the composition, i.e., the adsorption of the polymer from the solution of the composition serves to form the hydrophilic film on the hard surface treated and the partial dissolution of the formed film upon rinsing with a liquid, preferably a neutral liquid such as water, to provide for the removal of soil with the dissolved film. The simple rinsing, without wiping, occurs as separate rinsings taking place over an extended period of time during repeated use of the surface. These surfactant/polymer combinations lead to enhanced surface retention of hydrophilic polymer. The combinations of surfactant/polymer are less soluble at higher pH, due to decrease of polymer charge with increasing pH up to the isoelectric point of the charged polymer. Specifically, when residual film is rinsed with water, the pH of the film increases, and the surfactant/polymer retention is increased due to the lowered polymer solubility. If the amount of surfactant is too little in relation to the amount of polymer present, the surfactant will not combine with the polymer and will not adsorb to the surface. In this case, no enhancement of hydrophilicity occurs. If the surfactant is present in an amount too high in relation to the amount of polymer, the surfactant/polymer complex will be dominated by surfactant and the polymer will not be available for adsorption onto the surface and both the surfactant and polymer will redissolve when rinsed with water.

The hydrophilicity of the treated surface is maintained through a plurality of rinses since each rinse serves to redissolve only a portion of the barrier film. This redissolved portion is removed with the rinse liquid along with any soil thereon. The film retains hydrophilicity until all the polymer is redissolved and removed. Good sheeting (an indication of hydrophilicity) has been shown to be retained through 30 rinses before a fall in hydrophilicity occurred. The determination of whether the surface is hydrophilic and retains hydrophilicity can be shown by the measurement of or change in contact angle of the film in relation to the hard surface containing the film. As set forth above, FIG. 1 shows mean contact angles as achieved over 30 rinses for variations of a preferred embodiment of a composition of the invention providing residual cleaning benefits.

Preferred alkoxylated long chain alcohols are ethoxylated long chain alcohols, e.g. $C_{10}$-$C_{15}$ ethoxylated alcohols with 6-8 ethylene oxide groups. More preferably the ethoxylated long chain alcohols are ethoxylated $C_{10}$ Guerbet alcohols having an HLB of about 10 to about 15, preferably about 12 to about 15. Specific examples of ethoxylated Guerbet alcohols suitable for use are produced by BASF and sold under the tradenames LUTENSOL XL70, LUTENSEL XL60, LUTENSOL XL40, LUTENSOL XP80 and LUTENSOL XP100. An additional example of a nonionic surfactant is LUTENSOL A08 which is a $C_{13-15}$ ethoxylate fatty alcohol having 8 ethylene oxide groups.

The alkoxylated long chain alcohol is preferably present in relation to the hydrophilic polymer in the composition based on wt. % in a ratio range of about 7:1 to about 25:1, more preferably in a ratio of about 17:1. The alkoxylated long chain alcohol is preferably present in an amount of about 1.5 to about 5 wt. %, more preferably about 2 to about 3 wt. %, and most preferably is present in an amount of about 2.5 wt. %. In preferred formulas containing from 0.12 to 0.25 wt. % actives of MIRAPOL SURF S-210, the nonionic surfactant is preferably present in a ratio of a preferred nonionic surfactant LUTENSOL XL70 to polymer of 7.6 to 25.

Additional nonionic surfactants which may be present can be selected to enhance detergency and/or stability of the composition. For example, detergency can be enhanced by the inclusion of about 1 to about 3 wt. % of a nonionic surfactant such as an alkyl polyglycoside, e.g. Glucopan 425N. More particularly, the detergency enhancing nonionic surfactant is present in an amount of about 2 wt. %. Other detergency providing nonionic surfactants as conventionally known are also suitable for inclusion within an amount as defined above.

Nonionic surfactants includable to enhance stability of composition components, such as fragrance(s) if present, are secondary ethoxylated alcohols, such as $C_{11-15}$ secondary ethoxylated alcohols. Secondary ethoxylated alcohols suitable for use are sold under the tradename TERGITOL by Dow Chemical. TERGITOL 15-S is in particular suitable for use, more particularly TERGITOL 15-S-12 wherein the $C_{11-15}$ secondary ethoxylate alcohol has 12 ethylene oxide groups.

Surfactants which are not nonionic, i.e., anionic, cationic and amphoteric (including zwitterionic), are not suitable for inclusion in the cleaning composition of the present invention.

Anionic surfactants can not be present in the composition since such are negatively charged and would serve to neutralize the charge of the polymer. This neutralization would in turn prevent the polymer from attaching itself to a hard surface being treated, e.g. high energy surfaces such as glass, ceramic, metal and the like. Thus, an anionic surfactant in the composition would result in an undesirable film on the treated surface.

Cationic surfactants can not be included in the composition since such are positively charged. This positive charge would result in competition between the molecules of the surfactant and the molecules of the polymer for their adsorption to the charged sites on the high energy surface being treated thereby leading to a decrease in the amount of polymer adsorbed to the surface being treated. Thus, a cationic surfactant interferes with the retention of hydrophilicity by the treated surface.

Amphoteric surfactants, which include zwitterionic surfactants, also can not be present in the composition since such would be positively charged at the low pH of the cleaning composition. Thus, amphoteric surfactants would result in the same effect as cationic surfactants as described above.

The unsuitability of anionic, cationic and amphoteric surfactants is demonstrated by the following examples. Ceramic tiles were coated, respectively, with Formulas A-E as follows:

| Formula A (invention) | |
|---|---|
| Ingredients | Wt. % |
| Deionized Water | 87.15 |
| Lactic Acid (88%, Technical Grade) | 3.5 |
| LUTENSOL XL70 (100%)[1] | 2.5 |
| Alkyl Polyglycoside | 2.0 |
| $C_{11-15}$ Secondary Ethoxylated Alcohol with 12EO | 0.5 |
| Dipropylene Glycol Mono-Butyl Ether | 2.25 |
| Dipropylene Glycol N-Propyl Ether | 1.25 |
| MIRAPOL SURF S-210[2] | 0.75 |
| Fragrance | 0.1 |
| | 100% |

pH - 2.65

[1]Liquid alkoxylated $C_{10}$-Guerbet alcohol with 7EO nonionic surfactant

[2]Diallyl dimethyl ammonium acrylamide acrylic acid copolymer produced by Rhodia.

Formula B

Same as Formula A except LUTENSOL XL70 was replaced by dodecyl dimethyl ammonium chloride (50% actives), a cationic surfactant.

Formula C

Same as Formula A except LUTENSOL XL70 was replaced by disodium cocoamphodipropionate, an amphoteric surfactant.

Formula D

Same as Formula A except LUTENSOL XL70 was replaced by sodium dodecyl sulfate, an anionic surfactant.

Formula E

Same as Formula A except without the MIRAPOL SURF S-210 polymer.

Individual black ceramic tiles were identically coated with one of Formulas A-E and allowed to dry. The tiles were then rinsed in an identical manner with tap water for 2 minutes by a continuous spray. The tiles were then rinsed again in an identical manner with tap water for 5 minutes by continuous spray. The continuous spray used in each rinse is similar to a shower and was at a water temperature of 80-90° F. (27-32° C.) and at a flow rate of 50 ml/s. After drying, the contact angle between water and the surface of the tile was measured as to each tile to determine the hydrophilicity of the tile. Formula A had significantly lower contact angles (and thus greater hydrophilicity) as compared to the tiles treated with Formulas B-E. The contact angles as measured are set forth in Table 1 below.

TABLE 1

| | Contact Angle | |
|---|---|---|
| Formula | After 2 min Rinse | After 5 min Rinse |
| A (invention) | 17 | 19 |
| B (cationic) | 34 | 40 |
| C (amphoteric) | 35 | 36 |
| D (anionic) | 23 | 39 |
| E (without polymer) | 38 | 40 |

Solvent

Solvents suitable for use in the cleaning composition of the invention are those conventionally known for use in hard surface cleaners, in particular cleaners for high energy surfaces such as glass, ceramic, metal and the like, such as commonly found in households, especially bathrooms and kitchens. Solvents can be chosen based on desired volatile organic compound (VOC) content or toxicity requirements. Various mono-, di- and/or tri-alkylene glycol ethers and diethers are suitable for use, in particular mono-, di- and tri-ethylene glycol ethers and diethers and mono-, di- and tri-propylene glycol ethers and diethers. Various alkyl chain lengths are suitable for inclusion in such glycol ethers and diethers, e.g. methyl, ethyl, propyl, butyl, hexyl and the like. Preferred ethers and diethers have from 4-14 carbons, more particularly 6-12 carbons and most preferably 8-10 carbons.

Further specific examples of useful solvents include glycols (e.g. dodecaneglycol and propanediol), alkoxylated glycols (e.g. methoxy octandecanol and ethoxyethoxyethanol), benzyl alcohol, aliphatic branched alcohols (e.g. 2-methyl butanol and 2-ethyl butanol), alkoxylated aliphatic branched alcohols (e.g. 1-methylpropoxyethanol and 2-methoxybutoxyethanol), alkoxylated linear C1-C5 alcohols (e.g. n-BPP or butoxypropoxypropanol, butoxyethanol, butoxypropanol, ethoxyethanol or mixtures thereof), linear C1-C5 alcohols (e.g. methanol, ethanol, propanol or mixtures thereof), dibutyl glycol ether, and butyltriglycol ether.

Preferred solvents for use include n-propanol, isopropanol, butanol, ethyleneglycol butyl ether, diethylene glycol butyl ether, propylene glycol butyl ether, dipropylene glycol butyl ether, hexyl cellosolve, dipropylene glycol mono-butyl ether and dipropylene glycol n-propyl ether.

Most preferred solvents for inclusion are dipropylene glycol mono-butyl ether, dipropylene glycol n-propyl ether, butoxy propoxy propanol, butyl diglycol ether, benzyl alcohol, butoxy propanol, ethanol, methanol, isopropanol and mixtures thereof. The solvent component is preferably present in the cleaning composition in an amount of about 1 to about 4 wt. % of the composition.

Acid

The acid component is present to provide an acidic pH to the cleaning composition in a range of about 2 to about 3.5, preferably from about 2.5 to about 3, and most preferably from about 2.5 to about 2.65. Based on the differing pKa's of acids, the amount of acid present to provide the desired pH will vary based on the acid compound(s) selected to be present in the composition.

Acids suitable for inclusion in the cleaning composition of the invention include one or a mixture of mono-, di and tri-carboxy organic acids with a pKa of less than about 5, preferably less than about 4. These acids may also be mixed with inorganic acids.

Examples of organic acids suitable for inclusion are acetic, formic, lactic, hydroxyacetic, betahydroxyl propionic, citric, malic, adipic, glutaric, succinic acid and mixtures thereof, as well as tartaric, fumaric, gluconic, and glutamic. Amino acids and sulfamic acids interfere with performance of the polymer. Acids containing a nitrogen as a primary, secondary or tertiary amine are undesirable for inclusion. Examples of inorganic acids suitable for inclusion are hydrochloric, sulfuric, phosphoric and pyrophosphonic acids. Mixtures of mineral and organic acids are also suitable for use in the cleaning composition of the present invention.

Adjuvants

The cleaning composition may also include various adjuvants as conventional for hard surface cleaners. Examples of such adjuvants include one or more of a fragrance, preservative, dyes, corrosion inhibitors, antioxidants and the like. Adjuvants are generally present in an amount less than 0.5 wt. % and preferably are present in an amount of about 100 ppm to about 0.25 wt. % of the composition.

The overall cleaning composition of the invention provides initial cleaning of a hard surface to which it is applied to remove dirt, soap scum, limescale and the like therefrom. In addition, following treating of the hard surface, in particular a high energy hard surface such as glass, metal (e.g. chrome and stainless steel), ceramic, marble, and the like, the composition leaves on the hard surface a barrier film which provides a residual cleaning benefit over an extended period of time, i.e., the presence of a hydrophilic surface which has good sheeting action to repel soil and enhance removal of soil, drying and shine of the hard surface. The composition is preferably applied as a spray, preferably by a manual or trigger sprayer. No wiping is required. Rinsing with a liquid, preferably a neutral liquid such as water, following application of the composition serves to rinse away soil from the surface as well as solvent and surfactant not maintained with the polymer on the surface. After initial cleaning, the residual cleaning action is obtained by subsequent simple rinsing with a liquid, preferably simple water (pH=7), to maintain a clean, smooth surface. The rinse liquid serves to redissolve a surface portion of the film so as to remove soil thereon and obtain good sheeting action. Testing conducted using surfaces treated with cleaning compositions of the invention show that the residual cleaning benefit is retained and provided continuously over an extended number of rinsings, e.g., 30, 40 and 50 rinses, occurring over a period of time.

More particularly, the cleaning composition is preferably applied to a hard surface by spray for cleaning followed by rinsing and drying resulting in the retention on the treated surface of a film which is continuous and laterally heterogeneous (but not laterally homogeneous). The thickness of the film retained is not a critical parameter since the film thickness is not linked to the residual hydrophilicity obtained in the treated surface.

Composition Examples

Formulas of the invention are set forth below and numbered 1-9.

TABLE 1

| Material | 1 | 2 | 3 | 4 | 5 |
|---|---|---|---|---|---|
| Deionized Water | 87.15 | 87.6 | 87.3 | 86.9 | 86.75 |
| Lactic Acid 88% Technical Grade | 3.5 | 3.5 | 3.5 | 3.5 | 3.5 |
| Lutensol XL70 | 2.5 | 2 | 2 | 3 | 3 |
| Lutensol A08[1] | | | | | |
| Lutensol XL60[2] | | | | | |
| Alkyl Polyglycoside | 2 | 2 | 2 | 2 | 2 |
| $C_{11-15}$ Secondary Ethoxylated Alcohol With 12EO | 0.5 | 0.5 | 0.5 | 0.5 | 0.5 |
| Dipropylene Glycol N-Butyl Ether | 2.25 | 2.25 | 2.25 | 2.25 | 2.25 |
| Dipropylene Glycol N-Propyl Ether | 1.25 | 1.25 | 1.25 | 1.25 | 1.25 |
| Mirapol S-210 (20% actives) | 0.75 | 0.8 | 1.1 | 0.5 | 0.65 |
| Fragrance | 0.1 | 0.1 | 0.1 | 0.1 | 0.1 |
| TOTAL | 100.00 | 100.00 | 100.00 | 100.00 | 100.00 |
| Appearance | Sl Cloudy | Clear | Sl Cloudy | Clear | Clear |
| pH | 2.65 | 2.53 | 2.62 | 2.50 | 2.56 |

| Material | 6 | 7 | 8 | 9 |
|---|---|---|---|---|
| Deionized Water | 88.15 | 86.15 | 87.15 | 87.15 |
| Lactic Acid 88% Technical Grade | 3.5 | 3.5 | 3.5 | 3.5 |
| Lutensol XL70 | 2.5 | 2.5 | | |
| Lutensol A08[1] | | | 2.5 | |
| Lutensol XL60[2] | | | | 2.5 |
| Alkyl Polyglycoside | 1 | 3 | 2 | 2 |
| $C_{11-15}$ Secondary Ethoxylated Alcohol With 12EO | 0.5 | 0.5 | 0.5 | 0.5 |
| Dipropylene Glycol N-Butyl Ether | 2.25 | 2.25 | 2.25 | 2.25 |
| Dipropylene Glycol N-Propyl Ether | 1.25 | 1.25 | 1.25 | 1.25 |
| Mirapol S-210 (20% actives) | 0.75 | 0.75 | 0.75 | 0.75 |
| Fragrance | 0.1 | 0.1 | 0.1 | 0.1 |
| TOTAL | 100.00 | 100.00 | 100.00 | 100.00 |
| Appearance | Clear | Clear | Clear | Clear |
| pH | 2.54 | 2.57 | 2.43 | 2.49 |

[1] $C_{13-15}$ Ethoxylated Fatty Alcohol with 8 EO
[2] Alkoxylated $C_{10}$ Guerbet Alcohol with an HLB of 12

Formulas 1-9 as set forth above were tested with regard to sheeting action upon rinsing. Individual 4"×4" black flat tiles, number U759-44 produced by United States Ceramic Tile Co., served as the substrate. The test method utilized in the sheeting test individually as to each of Formulas 1-9 was as follows:

1. The tile was cleaned using FANTASTIK® Heavy Duty Antibacterial Cleaner (as commercially sold by S. C. Johnson & Son, Inc.), rinsed and dried with a paper towel.

2. The tile had applied to one half thereof 0.75 grams of one of Formulas 1-9 using a pipette and a small piece of damp paper towel. The other half of the tile was not treated with the test formula to provide for a control or comparison surface.

3. The tile was allowed to dry.

4. The entire surface of the tile was then rinsed under room temperature with tap water from a sink faucet in a left to right motion and back to the right at a controlled rate for 2-3 seconds.

5. The tile was removed from the water stream and the percentage of sheeting recorded after 10 seconds.

6. The tile was allowed to dry.

7. Steps 4-6 were repeated until no sheeting was noticed.

The sheeting percentage following each rinse with respect to Formulas 1-9 is set forth in Table 2 below. The sheeting percentage was based on measurement by visual estimation by a trained observer. The sheeting percentage was determined based on how much tile surface of the treated half of the tile was covered with water. The untreated half surface would be hydrophobic and less area thereof covered by water since the water would bead up to form small droplets on the surface. The half tile surface treated with the test formula would be hydrophilic, i.e., the water would spread over the entire surface which would indicate 100% sheeting as to the treated surface. High sheeting percentage is related to low contact angle since each of high sheeting percentage and low contact angle indicate water spreading over a surface, as compared to a low or zero percentage of sheeting and high contact angle which both indicate water beading up as spherical droplets on a surface and lack of spreading of the water on the surface. Thus, 100% sheeting indicates complete water coverage on the test surface. A decrease in percentage indicates less surface area being covered by water, i.e., decrease in spreading of the water on the surface.

TABLE 2

| | Formula Number | | | | | | | | |
|---|---|---|---|---|---|---|---|---|---|
| Rinse # | 1 | 2 | 3 | 4 | 5 | 6 | 7 | 8 | 9 |
| 1 | 100% | 100% | 100% | 100% | 100% | 100% | 100% | 100% | 100% |
| 2 | 100% | 100% | 100% | 100% | 100% | 100% | 100% | 100% | 100% |
| 3 | 100% | 100% | 100% | 100% | 100% | 100% | 100% | 100% | 100% |
| 4 | 100% | 100% | 100% | 100% | 100% | 100% | 100% | 100% | 100% |
| 5 | 100% | 100% | 100% | 100% | 100% | 100% | 100% | 100% | 100% |
| 6 | 100% | 100% | 100% | 100% | 100% | 100% | 100% | 90% | 100% |
| 7 | 100% | 100% | 100% | 90% | 100% | 100% | 100% | 90% | 100% |
| 8 | 100% | 100% | 100% | 90% | 100% | 100% | 100% | 90% | 100% |
| 9 | 100% | 100% | 100% | 90% | 100% | 100% | 100% | 90% | 100% |
| 10 | 100% | 100% | 100% | 90% | 100% | 100% | 100% | 80% | 90% |
| 11 | 100% | 100% | 100% | 90% | 100% | 100% | 100% | 80% | 80% |
| 12 | 100% | 100% | 100% | 90% | 100% | 100% | 100% | 80% | 80% |
| 13 | 100% | 100% | 100% | 90% | 100% | 100% | 100% | 40% | 70% |
| 14 | 100% | 100% | 100% | 90% | 100% | 100% | 100% | 30% | 70% |
| 15 | 100% | 100% | 100% | 80% | 100% | 100% | 100% | 30% | 60% |
| 16 | 100% | 100% | 100% | 70% | 100% | 100% | 100% | 30% | 60% |
| 17 | 100% | 100% | 100% | 70% | 100% | 100% | 100% | 30% | 60% |
| 18 | 100% | 100% | 100% | 70% | 100% | 90% | 100% | 30% | 60% |
| 19 | 100% | 100% | 100% | 70% | 100% | 90% | 100% | 30% | 60% |
| 20 | 100% | 100% | 100% | 70% | 100% | 80% | 100% | 30% | 60% |

Comparison testing was conducted using Formulas 10-16 below. Formula 10 is a composition of the invention. Formulas 11-13 have the same ingredients as Formula 10 except that the polymer has been changed to be POLYQUART AMPHO 149, an aqueous acrylic acid polymer produced by Cognis having the chemical name N,N,N-trimethyl-3-[(2-methyl-1-oxo-2-propenyl)amino]-1-propanaminium chloride polymer with ethyl 2-propenoate and sodium propenoate. POLYQUART AMPHO 149 is used in different amounts as to Formulas 11-13 as is the surfactant LUTENSOL XL70. Formulas 14-16 are the same as Formula 10 except that the surfactant LUTENSOL XL70 was replaced by LUTENSOL XL60 and the polymer MIRAPOL SURF S-210 was replaced by SOKALAN HP 70, a water-soluble modified polyamine produced by BASF. SOKALAN HP 70 is a water-soluble polymer including homo- or co-polymers on the basis of vinylpyrrolidone, vinylimidazole and monomers with non-ionic character.

| Material | 10 | 11 | 12 | 13 |
|---|---|---|---|---|
| Deionized Water | 87.1 | 85.85 | 88.35 | 87.1 |
| Lactic Acid 88% Technical Grade | 3.5 | 3.5 | 3.5 | 3.5 |
| $C_{11-15}$ Secondary Ethoxylated Alcohol With 12EO | 0.5 | 0.5 | 0.5 | 0.5 |
| Lutensol XL70 | 2.5 | 2.5 | 1.5 | 2 |
| Lutensol XL60 | | | | |
| Alkyl Polyglycoside | 2 | 2 | 2 | 2 |
| Dipropylene Glycol N-Butyl Ether | 2.25 | 2.25 | 2.25 | 2.25 |
| Dipropylene Glycol N-Propyl Ether | 1.25 | 1.25 | 1.25 | 1.25 |
| Fragrance | 0.15 | 0.15 | 0.15 | 0.15 |
| Mirapol S-210 | 0.75 | | | |
| Polyquart Ampho 149 | | 2 | 0.5 | 1.25 |
| Sokalan HP70 | | | | |
| TOTAL | 100.00 | 100.00 | 100.00 | 100.00 |
| pH | 2.60 | 2.45 | 2.38 | 2.42 |
| 30 Day 40 C. Stability | OK | OK | OK | OK |
| 60 Day 40 C. Stability | OK | OK | OK | OK |
| 90 Day 40 C. Stability | OK | OK | OK | OK |
| 30 Day Room Temperature Stability | OK | OK | OK | OK |
| 60 Day Room Temperature Stability | OK | OK | OK | OK |
| 90 Day Room Temperature Stability | OK | OK | OK | OK |

-continued

| Material | 14 | 15 | 16 |
|---|---|---|---|
| Deionized Water | 88.35 | 85.85 | 87.1 |
| Lactic Acid 88% Technical Grade | 3.5 | 3.5 | 3.5 |
| $C_{11-15}$ Secondary Ethoxylated Alcohol With 12EO | 0.5 | 0.5 | 0.5 |
| Lutensol XL70 | | | |
| Lutensol XL60 | 1.5 | 2.5 | 2 |
| Alkyl Polyglycoside | 2 | 2 | 2 |
| Dipropylene Glycol N-Butyl Ether | 2.25 | 2.25 | 2.25 |
| Dipropylene Glycol N-Propyl | 1.25 | 1.25 | 1.25 |

-continued

| | | | |
|---|---|---|---|
| Ether | | | |
| Fragrance | 0.15 | 0.15 | 0.15 |
| Mirapol S-210 | | | |
| Polyquart Ampho 149 | | | |
| Sokalan HP70 | 0.5 | 2 | 1.25 |
| TOTAL | 100.00 | 100.00 | 100.00 |
| pH | 2.46 | 2.55 | 2.51 |
| 30 Day 40 C. Stability | OK | Yellow | Sl. Yellow |
| 60 Day 40 C. Stability | OK | Yellow | Sl. Yellow |
| 90 Day 40 C. Stability | OK | Yellow | Sl. Yellow |
| 30 Day Room Temperature Stability | OK | OK | OK |
| 60 Day Room Temperature Stability | OK | OK | OK |
| 90 Day Room Temperature Stability | OK | OK | OK |

Formulas 10-16 were tested to determine sheeting action thereof in the same manner as for Formulas 1-9 as described above. The sheeting percentage as to Formulas 10-16 is set forth in Table 3 below.

TABLE 3

| | Formula Number | | | | | | |
|---|---|---|---|---|---|---|---|
| Rinse # | 10 | 11 | 12 | 13 | 14 | 15 | 16 |
| 1 | 100% | 100% | 100% | 100% | 100% | 100% | 100% |
| 2 | 100% | 100% | 80% | 90% | 90% | 100% | 100% |
| 3 | 100% | 60% | 0% | 50% | 50% | 100% | 90% |
| 4 | 100% | | | 40% | 20% | 70% | 80% |
| 5 | 100% | | | | | 40% | 60% |
| 6 | 100% | | | | | 30% | 40% |
| 7 | 100% | | | | | | 30% |
| 8 | 100% | | | | | | |
| 9 | 100% | | | | | | |
| 10 | 90% | | | | | | |
| 11 | 90% | | | | | | |
| 12 | 90% | | | | | | |
| 13 | 90% | | | | | | |
| 14 | 90% | | | | | | |
| 15 | 90% | | | | | | |
| 16 | 80% | | | | | | |
| 17 | 80% | | | | | | |

As clear from the testing results, the Formulas of the invention have clearly superior sheeting action. Sheeting action is advantageous as to removal of soil upon rinsing, drying and shine of the hard surface treated with such composition.

The sheeting action, and residual cleaning effect therefrom, are imparted to the treated hard surface by the cleaning composition. The hydrophilicity is maintained through numerous rinses. When a treated surface is rinsed with a liquid, e.g. simple water, a new polymer surface emerges as some of the old polymer complex dissolves and is rinsed away. Thus, dirt, soap scum or the like on the' top of the barrier film layer is also removed upon rinsing.

Figure 2:
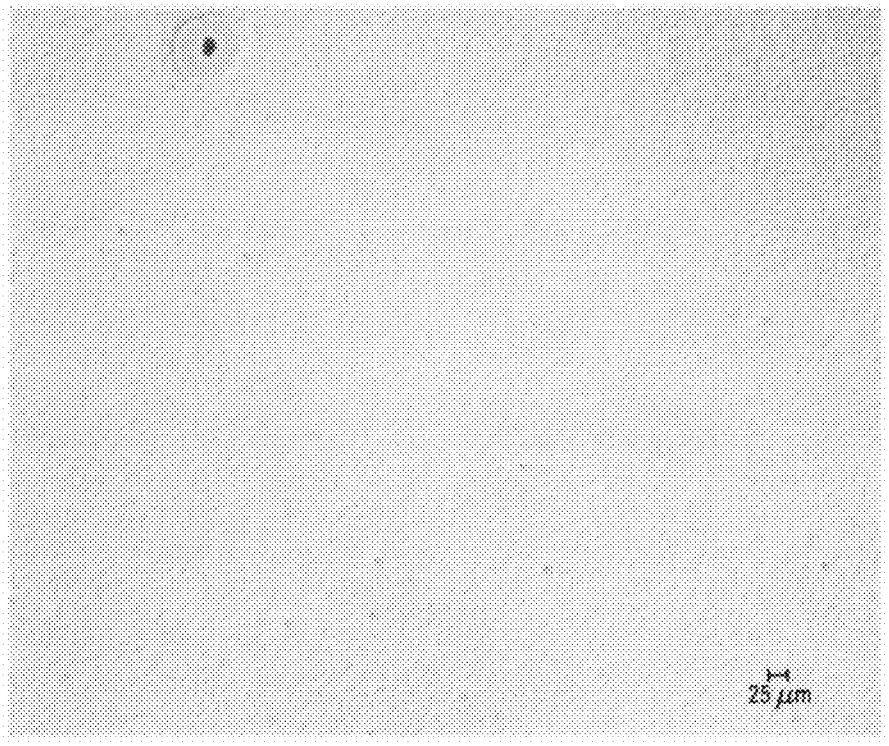
FIG. 2 shows an optical micrograph of a glass surface treated with the composition denoted as Formula 1 following drying but prior to subsequent rinsing.
Figure 3:
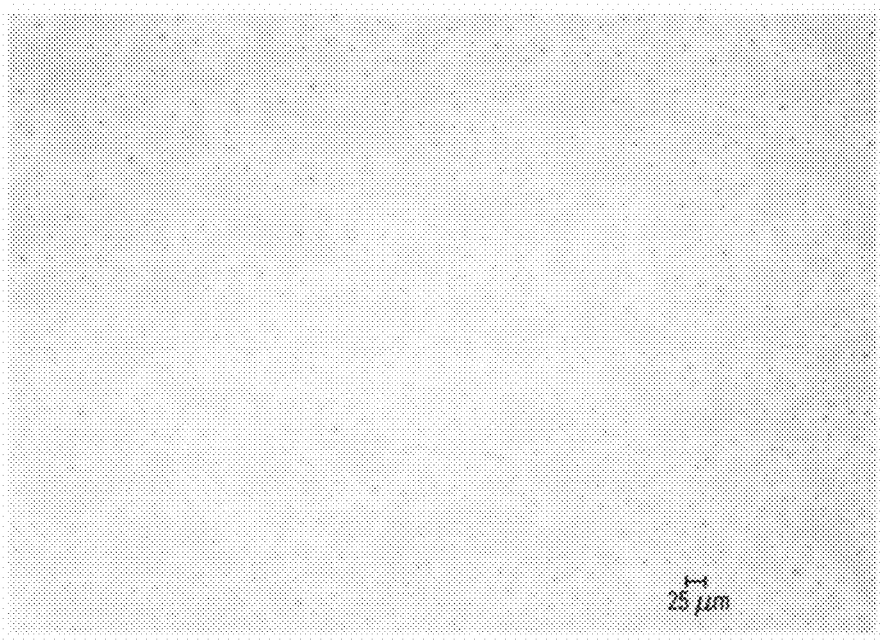
FIG. 3 shows an optical micrograph of a glass surface treated with a composition the same as Formula 1 except not containing the polymer, following drying but prior to subsequent rinsing.

FIG. 2 shows an optical micrograph of a glass surface having a film formed thereon following being treated with a composition of Formula 1 (as set forth above), by soaking the glass slides in the composition of Formula 1 for 30 seconds and then spin drying at 2000 rpm for 1 minute and being left overnight in a clean closed box to dry. FIG. 3 shows an optical micrograph of a glass surface having a film formed thereon following being treated with a composition the same as Formula 1 except not containing the polymer MIRAPOL SURF S-210, by soaking the glass slides in the Formula for 30 seconds and then spin drying at 2000 rpm for 1 minute and being left overnight in a clean closed box to dry. Comparison of FIGS. 2 and 3 shows that the composition of the invention provides for more uniform film levels and, thus, film coating of the treated surface.

Figure 4:
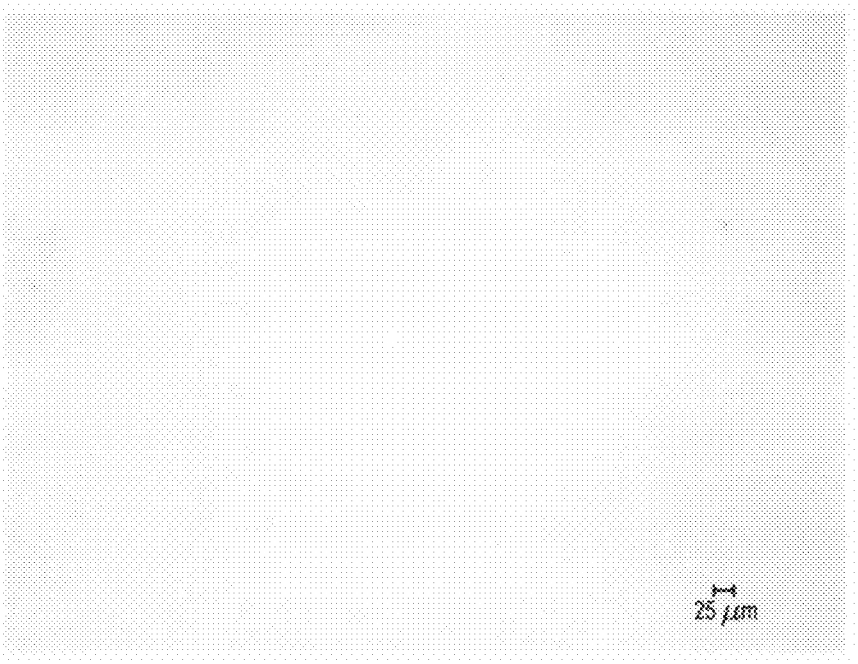
FIG. 4 shows an optical micrograph of the glass surface of FIG. 2 following subsequent rinsing with water illustrating retention of a smooth film on the glass surface.
Figure 5:
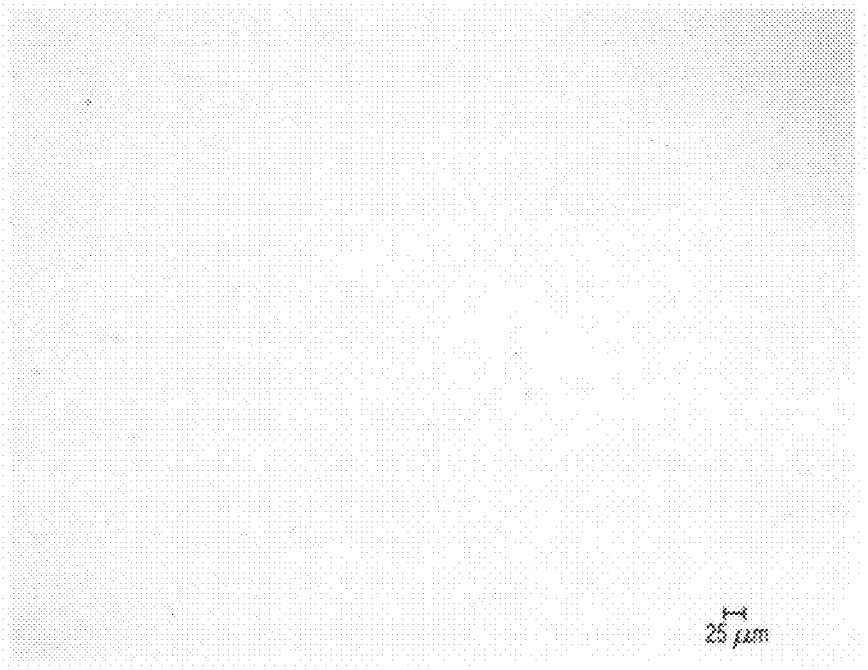
FIG. 5 shows an optical micrograph of the glass surface of FIG. 3 following an identical subsequent rinsing as carried out as to the surface of FIG. 4 wherein an uneven or blotchy film on the glass surface has occurred.

FIGS. 4 and 5 show further optical micrographs of the glass surfaces of FIGS. 2 and 3, respectively, following 3 subsequent rinses with deionized water and later spin drying it at 2000 rpm for 1 minute and leaving it overnight in a clean closed box for drying. A comparison of FIGS. 4 and 5 show that the surface of FIG. 4 treated with a composition of the invention still provides a smooth uniform film, whereas the composition without the polymer is no longer uniform and is significantly reduced. FIG. 4 shows that the polymer in the residual film contributes to formation and retention of a smoother film that promotes better surface appearance and consistent residual cleaning over the treated surface.

The hydrophilicity of a hard surface is also increased following treatment of the hard surface with a composition of the invention followed by drying before subsequent rinsing.

Figure 6:
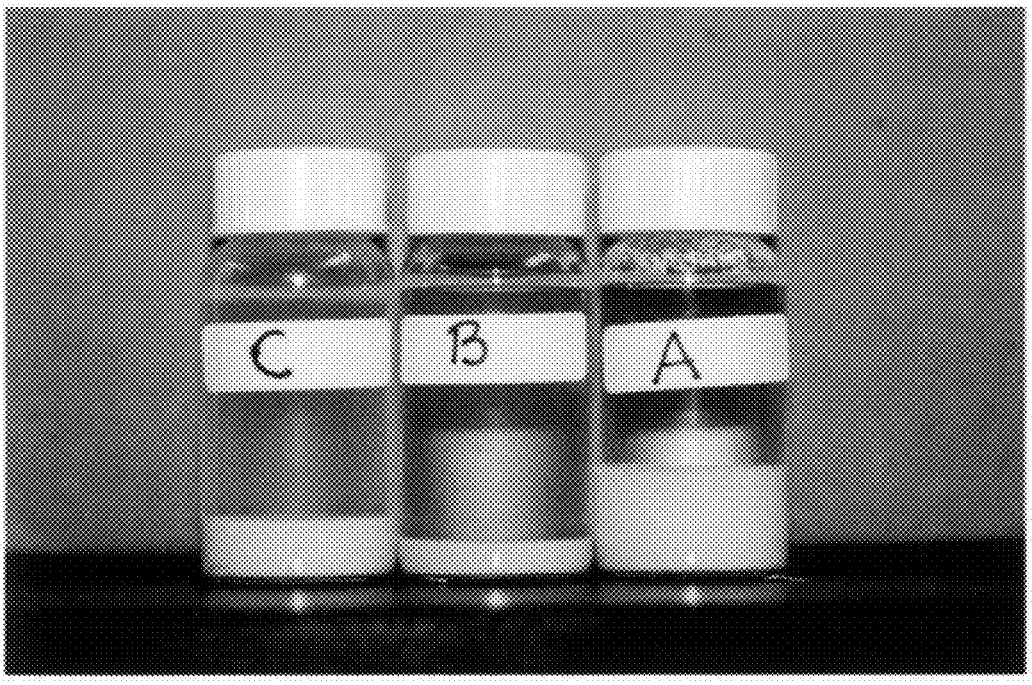
FIG. 6 shows test results illustrating the improved adsorption of the polymer from a composition of the invention onto powdered $SiO_2$.

A further test was conducted to demonstrate that the composition of Formula 1 provides the benefit of enhanced polymer adsorption onto a surface. The test (results being shown in FIG. 6) shows that Formula 1 (denoted as A in FIG. 6) changes and enhances the adsorption of polymer onto a surface as compared to the same concentration of polymer alone (denoted as C in FIG. 6), and as compared to Formula 1 without the polymer (denoted as B in FIG. 6). The test procedure utilized mimics application of the composition in use to a glass or ceramic surface. Each test composition A, B and C was added in an amount of 10 ml to 2.5 grams of $SiO_2$ powder in a tube and the tube shaken vigorously. Thereafter, the $SiO_2$ powder was allowed to settle in the liquid for at least 18 hours. The image in FIG. 6 was captured at this time. The height of the powder column in the tube was measured. As shown in FIG. 6, the adsorption of Formula 1 (composition A) is substantially higher than adsorption from a polymer solution without surfactants (B in FIG. 6) and a composition not containing a polymer (C in FIG. 6). Thus, the test illustrates two properties which change on adsorption, namely (1) particle adsorption on glass is enhanced by Formula 1 and (2) the height of the settled layer is increased. The settling on the powder of Formula 1 is hindered because particle-particle adhesion does not allow particles to slip and move past one another. Since the particles do not settle, the powder treated with Formula 1 maintains a higher column. The adhesion is increased due to attraction between polymer coated particles. Polymer coated particles from Formula 1 are also strongly attracted to the glass tube wall as compared to powder treated with the polymer alone in water.

As set forth above, contact angle is also an indication of the degree of hydrophilicity of a hard surface following treatment of the surface with the cleaning composition. The cleaning composition is useful with high energy surfaces, such as glass, ceramic, marble, metal (e.g. chrome and stainless steel), and the like. The composition does not exhibit the same residual cleaning benefits on plastic surfaces, such as plexiglass, polyester or acrylic surfaces.

Contact angle for determining hydrophilicity imparted to a surface treated with a composition can be tested on an initial basis as well as over an extended period of rinsing.

A simple test (for reference purposes denoted as "Test A") for determining contact angle after an initial cleaning is a manual test using a NRL C.A. Goniometer, Model No. 100-00-115 (Rame-Hart, Mountain Lakes, N.J.). Black tiles were identically pretreated with 4 sprays of a specific composition and, thereafter, allowed to dry for 10 minutes. Water contact angle was then measured on several points of the tile. The tiles were then identically rinsed with 10 sprays of water, dried for 30 minutes and the water contact angle obtained. Test results as to a formula of the invention (denoted as Formula A above) and the same formula except without the polymer is set forth in Table 4 below.

TABLE 4

| Composition | Water Contact Angle Initial | After 10 Sprays |
|---|---|---|
| Untreated Tile | 32 | 38 |
| Formula A Without Polymer | 1.4 | 27 |
| Formula A | 0 | 6 |

A further test method (for reference purposes denoted as "Test B") for determining contact angle was carried out to show the change over an extended series of rinsings for various compositions of the invention. The compositions tested, Formulas 17-29, are based on Formula A as set forth above but modified as to the amount of polymer, MIROPOL SURF S-210, and the nonionic surfactant LUTENSOL XL70 as noted below in Table 5. Further, in Formulas 19 and 20 as noted LUTENSOL XL70 was replaced with LUTENSOL XL60 and LUTENSOL A08, respectively.

The procedure of Test B for preparing substrates for testing, application of the test formulas, rinsing and measuring the contact angle on substrates treated with the test formulas, the results being in Table 5 below, was as follows:

I. Preparation, Application and Rinsing Procedure

1. Soak conventional ceramic tiles (4"×4" black flat tiles, number U759-44 produced by United States Ceramic Tile Co.) in an acid cleaner solution for 30 minutes (5 mL of toilet bowl cleaner in 1000 mL of water).
2. Wash the tiles with FANTASTIK® Clean & Shine, All Purpose cleaner (as sold by S. C. Johnson & Son, Inc.) and tap water for 2 minutes. Rinse with tap water and deionized water.
3. Wipe-dry with WYPALL tissue (as sold by Kimberly-Clark) and KIMWIPES (as sold by Kimberly-Clark).
4. Leave to dry for 30 minutes.
5. Place the tile on a stand at an angle of 75°.
   Apply the test composition by spraying it 4 times on the tile and leaving it on the stand for 1 minute.
6. Place the tile against the wall at 60° and air dry the tile for 30 minutes.
7. Place the tile on a stand at an angle of 75°. Rinse the tile by spraying the tile, using a conventional trigger spray bottle, 10 times (i.e., 10 single trigger pulls) with tap water.
8. Air dry the tile for 30 minutes with the tile standing against the wall at 60°.

II. Contact Angle Measurement

Drops of the same volume of deionized water were placed on 9 different spots on the surface of the tile and using a NRL C.A Goniometer, Model No. 100-00-115 (Rame-Hart, Inc., Mountain Lakes, N.J.), contact angle is measured at these different locations.

| | | |
|---|---|---|
| 9 | 3 | 6 |
| 7 | 1 | 4 |
| 8 | 2 | 5 |

The contact angle was initially measured on the surface of the tile prior to any rinsing. Thereafter, following every 10 rinses with tap water and drying (steps 7 and 8 above), contact angles were measured on the surface of the tile as described above. The rinse cycle and drying (steps 7 and 8 above) were repeated to obtain an average contact angle on the surface of the tile after each of 10 rinses, 20 rinses, 30 rinses and 40 rinses. The contact angles obtained are set forth in Table 5 below.

TABLE 5

| Solution | % S-210 (20% actives) | % XL70 | % XL60 | % A08 | Contact angle after 0 rinse | Contact angle after 10 rinses |
|---|---|---|---|---|---|---|
| 17 | 0.75 (0.15) | 2.5 | | | ¯1 | 5.51 ± 1.33 |
| 18 | 0 (0) | 2.5 | | | ¯2.8 | 19.27 ± 3.02 |
| 19 | 0.75 (0.15) | | 2.5 | | ¯1 | 6.51 ± 0.97 |
| 20 | 0.75 (0.15) | | | 2.5 | ¯1 | 8.16 ± 1.58 |
| 21 | 0.8 (0.16) | 2 | | | ¯1 | 8.62 ± 1.88 |
| 22 | 1.1 (0.22) | 2 | | | ¯1 | 9.33 ± 1.19 |
| 23 | 0.5 (0.1) | 3 | | | ¯1 | 8.64 ± 1.25 |
| 24 | 0.65 (0.13) | 3 | | | ¯1 | 7.62 ± 1.15 |
| 25 | 2 (0.4) | 1.5 | | | ¯1 | 6.91 ± 1.61 |
| 26 | 0.5 (0.1) | 2.5 | | | ¯1 | 7.12 ± 1.06 |
| 27 | 0.5 (0.1) | 1.5 | | | ¯1 | 6.63 ± 0.94 |
| 28 | 2 (0.4) | 2.5 | | | ¯1 | 7.43 ± 1.30 |
| 29 | 1.25 (0.25) | 2 | | | ¯1 | 6.38 ± 1.14 |

| Solution | Contact angle after 20 rinses | Contact angle after 30 rinse | Contact angle after 40 rinses |
|---|---|---|---|
| 17 | 6.14 ± 1.95 | 10.01 ± 3.36 | 27.74 ± 6.35 |
| 18 | 25.35 ± 4.58 | — | — |
| 19 | 14.54 ± 3.26 | 21.79 ± 4.95 | 31.82 ± 3.99 |
| 20 | 15.18 ± 3.18 | 22.5 ± 4.36 | 29.17 ± 2.43 |
| 21 | 8.62 ± 1.23 | 9.83 ± 2.25 | 24.26 ± 3.32 |
| 22 | 9.76 ± 2.72 | 21.11 ± 4.82 | 27.84 ± 3.86 |
| 23 | 13.63 ± 6.40 | 20.22 ± 3.85 | 24.19 ± 4.72 |
| 24 | 7.07 ± 1.24 | 12.43 ± 3.23 | 30.84 ± 2.14 |
| 25 | 8.32 ± 0.90 | 15.56 ± 3.10 | 24.72 ± 4.72 |
| 26 | 8.17 ± 1.47 | 23.94 ± 5.55 | 26.71 ± 3.73 |
| 27 | 9.46 ± 1.59 | 21.8 ± 3.93 | 26.26 ± 4.82 |
| 28 | 12.52 ± 3.93 | 25.1 ± 3.56 | 27.18 ± 3.02 |
| 29 | 11.98 ± 7.89 | 16.1 ± 1.79 | 23.7 ± 3.30 |

¯1 = Drop of water will spread all over in less than 10 seconds with 0 rinses.

The contact angle results above illustrate the retention as well as the change in hydrophilicity through multiple separate rinsings occurring over an extended period of rinsing. Further, the results indicate the relationship between the polymer and nonionic surfactant. The surfactant/polymer combinations lead to an enhanced surface retention of hydrophilic polymer and are less soluble at higher pH due to decrease of polymer charge with increasing pH up to the isoelectric point of the charged polymer. Specifically, when the residual film is rinsed with water, the pH of the film increases and the surfactant/polymer retention is increased due to the lowered polymer solubility. If the amount of surfactant is too little in relation to the amount of polymer present, the surfactant will not combine with the polymer and will not adsorb to the surface and, thus, no enhancement of hydrophilicity occurs. If the surfactant is present in an amount too high in relation to the amount of polymer, the surfactant/polymer combination will be dominated by surfactant and the polymer will not be available for adsorption onto the surface and both the surfactant and polymer will redissolve when rinsed with water.

The following example illustrates how the performance of a composition of the invention (as used and exemplified here by Formula 1 as set forth above) is affected by the HLB of the surfactant, the acid and the partial replacement of the polymer, i.e., MIRAPOL SURF S-210 is partially replaced by ACUSOL 445 (produced by Rohm & Haas). ACUSOL 445 is a homopolymer of an acrylic acid present in partially neutralized Na form, and has 48% solids. In the test, the wt. % of the polymers was set constant at 0.75 wt. % and the ratio ACUSOL 445/MIRAPOL SURF S-210 was varied (445/S210). The same protocol was used to clean the tiles and to form the film on the tiles as described above with respect to the testing conducted as to Formulas 17 to 29, as was the manner of measuring the contact angle. The contact angle measurement was performed after 30 rinses. The results are set forth below in Table 6. Acids used: lactic acid, citric acid, and hydrochloric acid. Surfactants used: LUTENSOL XL40 (HLB=10.5), LUTENSOL XL70 (HLB=13), LUTENSOL XL100 (HLB=15). All other components of Formula 1 were kept constant.

TABLE 6

| Solution | HLB | Acid | 445/S210 | Contact Angle |
|---|---|---|---|---|
| Black tile | | | | 35.66 ± 7.75 |
| Formula 1 | 13 | lactic | 0/0.75 | 14.49 ± 4.46 |
| Formula 1 w/o Polymer | 13 | lactic | 0/0 | 31.12 ± 3.29 |
| 30 | 15 | HCl | 0.5/0.25 | 19.07 ± 8.35 |
| 31 | 15 | lactic | 0.25/0.5 | 33.28 ± 2.66 |
| 32 | 15 | citric | 0.25/0.5 | 25.32 ± 3.73 |
| 33 | 13 | HCl | 0.25/0.5 | 23.94 ± 3.02 |
| 34 | 10.5 | lactic | 0.25/0.5 | 16.60 ± 3.49 |
| 35 | 13 | lactic | 0.5/0.25 | 24.26 ± 7.76 |
| 36 | 15 | lactic | 0.5/0.25 | 29.75 ± 4.24 |
| 37 | 15 | HCl | 0.25/0.5 | 27.81 ± 2.93 |
| 38 | 13 | HCl | 0.5/0.25 | 25.28 ± 3.98 |
| 39 | 10.5 | citric | 0.25/0.5 | 12.14 ± 3.74 |
| 40 | 13 | citric | 0.5/0.25 | 21.31 ± 4.33 |
| 41 | 10.5 | citric | 0.5/0.25 | 19.72 ± 3.90 |
| 42 | 10.5 | HCl | 0.5/0.25 | 32.72 ± 2.13 |

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A hard surface cleaning composition comprising (a) about 0.05 to about 1 wt. % based on actives of a hydrophilic polymer comprising (1) an acidic monomer having or capable of forming an anionic charge, (2) a monomer having a permanent cationic charge or is capable of forming a cationic charge upon protonation, and (3) optionally, a monomer having a neutral charge;

(b) about 1.5 to about 5 wt. % of at least one nonionic surfactant, said at least one nonionic surfactant including at least one alkoxylated alcohol and said at least one alkoxylated alcohol is present in relation to said polymer based on wt. % in a ratio of 7:1 to 25:1;

(c) about 1 to about 4 wt. % of at least one solvent;

(d) at least one acid in an amount sufficient to provide said cleaning composition with an acidic pH in a range of about 2 to about 3.5;

(e) a balance of water;

wherein said cleaning composition is provided in absence of any anionic, cationic or amphoteric surfactant.

2. The cleaning composition of claim 1, wherein said at least one alkoxylated alcohol is present in relation to said polymer based on wt. % in a ratio of 17:1.

3. The cleaning composition of claim 1, wherein said acidic pH is from about 2.5 to about 3.

4. The cleaning composition of claim 1, wherein said acidic pH is from about 2.5 to about 2.65.

5. The cleaning composition of claim 1, wherein said hydrophilic polymer is a quaternized ammonium acrylamide acrylic acid copolymer.

6. The cleaning composition of claim 1, wherein said hydrophilic polymer is diallyl dimethyl ammonium acrylamide acrylic acid copolymer.

7. The cleaning composition of claim 1, wherein said polymer is present in an amount of about 0.1 to about 0.4 wt. % based on actives.

8. The cleaning composition of claim 5, wherein said polymer is present in an amount of about 0.1 to about 0.4 wt. % based on actives.

9. The cleaning composition according to claim 1, wherein said polymer is present in an amount of about 0.13 to about 0.16 wt. % based on actives.

10. The cleaning composition according to claim 5, wherein said polymer is present in an amount of about 0.13 to about 0.16 wt. % based on actives.

11. The cleaning composition of claim 1, wherein said at least one solvent is at least one mono-, di- or tri-alkylene glycol ether or diether.

12. The cleaning composition of claim 11, wherein said at least one alkylene glycol ether or diether has 4 to 14 carbon atoms.

13. The cleaning composition of claim 1, wherein said at least one nonionic surfactant further includes an alkyl polyglycoside.

14. The cleaning composition of claim 1, wherein said at least one nonionic surfactant further includes a secondary ethoxylated alcohol.

15. The cleaning composition of claim 13, wherein said at least one nonionic surfactant further includes a secondary ethoxylated alcohol.

16. The cleaning composition of claim 1, wherein said at least one alkoxylated alcohol is an ethoxylated $C_{10}$ Guerbet alcohol having an HLB of about 10 to about 15.

17. The cleaning composition of claim 1, wherein said composition provides to a hard surface a continuous lateral heterogeneous film following coating said hard surface with said cleaning composition.

18. The cleaning composition of claim 1, wherein said polymer and said at least one alkoxylated alcohol are present in amounts relative to each other to provide an average contact angle of less than 30 following 30 rinses, where contact angle is measured according to Test B.

19. A hard surface cleaning composition comprising (1) at least one first nonionic ethoxylated alcohol surfactant having an HLB in a range of from about 10 to about 15;

(2) a hydrophilic acrylic acid based amine-functional polymer;

(3) at least one acid in an amount sufficient to provide a pH to said composition of from about 2 to about 3.5;

(4) optionally at least one additional nonionic surfactant which is different from said at least one first nonionic surfactant;

(5) at least one alkylene ether solvent; and (6) water, wherein said composition is provided in absence of any anionic, cationic or amphoteric surfactant; wherein said at least one first nonionic surfactant is present in relation to said polymer based on wt. % in a ratio of 7:1 to 25:1; and wherein when said composition is applied in aqueous solution to a hard surface, said composition provides a hydrophilic film on said hard surface, said film only partially dissolving upon each subsequent rinsing with a liquid having a neutral pH such that said surface retains hydrophilicity based on said film through a plurality of rinses with said liquid having a neutral pH.

20. A hard surface cleaning composition comprising (a) about 0.05 to about 1 wt. % based on actives of a hydrophilic polymer comprising a quaternized ammonium acrylamide acrylic acid copolymer;

(b) about 1.5 to about 5 wt. % of a nonionic water-soluble ethoxylated $C_{10}$ Guerbet alcohol with 7 ethylene oxide groups;

(c) about 1 to about 3 wt. % of an alkyl polyglycoside;

(d) about 1 to about 4 wt. % of at least one mono-, di- or tri-alkylene glycol ether solvent;

(e) at least one acid in an amount sufficient to provide said cleaning composition with an acidic pH in a range of from about 2 to about 3.5; and (f) a balance of water;

wherein said cleaning composition is provided in absence of any anionic, cationic or amphoteric surfactant.

21. The cleaning composition of claim 20, wherein said copolymer is a diallyl dimethyl ammonium acrylamide acrylic acid copolymer.

22. The cleaning composition of claim 20, wherein said copolymer is present in an amount of about 0.1 to about 0.4 wt. % based on actives.

23. The cleaning composition of claim 20, wherein said copolymer is present in an amount of about 0.15 wt. % based on actives.

* * * * *